US006554608B1

(12) United States Patent
Bowman et al.

(10) Patent No.: US 6,554,608 B1
(45) **Date of Patent: *Apr. 29, 2003**

(54) APPARATUS AND METHOD FOR SENSING FLAMMABLE VAPOR

(75) Inventors: John A. Bowman, Lancaster, MA (US); Karen R. Benedek, Winchester, MA (US); Stephan E. Schmidt, Winchester, MA (US)

(73) Assignee: Gas Research Institute, Des Plaines, IL (US)

( * ) Notice: Subject to any disclaimer, the term of this patent is extended or adjusted under 35 U.S.C. 154(b) by 28 days.

This patent is subject to a terminal disclaimer.

(21) Appl. No.: 09/678,589

(22) Filed: Oct. 3, 2000

Related U.S. Application Data

(60) Division of application No. 09/307,124, filed on May 7, 1999, now Pat. No. 6,139,311, which is a continuation-in-part of application No. 09/009,807, filed on Jan. 20, 1998, now Pat. No. 6,074,200.

(51) Int. Cl.[7] ..... F23N 5/24

(52) U.S. Cl. ..... 431/6; 431/22; 431/278

(58) Field of Search ..... 431/278, 281, 431/284, 285, 353, 350, 354, 12, 8, 6, 22, 77; 126/350.1; 122/17.1, 19.2, 494; 220/694.1

(56) References Cited

U.S. PATENT DOCUMENTS

| | | | | |
|---|---|---|---|---|
| 768,753 A | | 8/1904 | Kaufman | 431/284 |
| 1,600,175 A | | 9/1926 | Hughes | 431/180 |
| 1,933,318 A | | 10/1933 | Doen | 431/277 |
| 2,098,489 A | * | 11/1937 | Everhard | 122/19.2 |
| 2,112,655 A | * | 3/1938 | Morrow | 241/65 |
| 2,781,977 A | | 2/1957 | Stanley et al. | |
| 3,407,022 A | | 10/1968 | Andrews et al. | 431/8 |
| 3,656,878 A | | 4/1972 | Wright | 431/353 |
| 3,894,834 A | | 7/1975 | Estes | 431/8 |
| 3,988,104 A | | 10/1976 | Barber | 431/12 |
| 4,041,694 A | | 8/1977 | Lewis | 431/12 |
| 4,043,742 A | | 8/1977 | Egan et al. | 431/12 |
| 4,097,223 A | | 6/1978 | Garnier | 431/353 |
| 4,097,239 A | | 6/1978 | Patterson | 431/284 |
| 4,161,387 A | | 7/1979 | Courier de Méré | 431/75 |
| 4,315,729 A | | 2/1982 | Tanaka et al. | 431/75 |
| 4,395,226 A | | 7/1983 | Nakanishi et al. | 431/116 |
| 4,544,348 A | | 10/1985 | Boij | |
| 4,613,300 A | | 9/1986 | Simpson | 126/116 A |
| 4,627,416 A | | 12/1986 | Ito et al. | |
| 4,777,933 A | | 10/1988 | Ruark | 126/361 |
| 4,830,601 A | | 5/1989 | Dahlander et al. | 431/12 |
| 4,872,443 A | | 10/1989 | Ruark | 126/361 |
| 4,913,647 A | | 4/1990 | Bonne et al. | 431/12 |
| 4,924,816 A | | 5/1990 | Moore, Jr. et al. | 122/17.1 |
| 4,927,351 A | | 5/1990 | Hagar et al. | 431/12 |
| 5,026,272 A | | 6/1991 | Takahashi et al. | 431/78 |

(List continued on next page.)

FOREIGN PATENT DOCUMENTS

| | | |
|---|---|---|
| EP | 0 382 893 B1 | 12/1993 |
| EP | 0 727 613 A1 | 8/1996 |

*Primary Examiner*—Henry Bennett
*Assistant Examiner*—Josiah Cocks
(74) *Attorney, Agent, or Firm*—Mark E. Fejer

(57) ABSTRACT

An apparatus and method for operating a pilot burner apparatus and a main burner apparatus of a gas-fired appliance. The pilot burner apparatus draws combustion air from a first environment. The main combustion apparatus draws air from a second environment. In a shutdown condition, such as when a flammable vapor source is accidentally exposed to the second environment, the pilot burner apparatus draws air containing an undesired flammable vapor which eliminates the pilot flame, triggering a gas valve to close and shut down the fuel gas supply to the main burner apparatus and the pilot burner apparatus.

9 Claims, 15 Drawing Sheets

U.S. PATENT DOCUMENTS

| | | | | |
|---|---|---|---|---|
| 5,037,291 | A | | 8/1991 | Clark ..... 431/75 |
| 5,049,063 | A | | 9/1991 | Kishida et al. ..... 431/78 |
| 5,085,205 | A | | 2/1992 | Hall et al. ..... 122/17.1 |
| 5,139,413 | A | | 8/1992 | Son et al. ..... 431/77 |
| 5,190,454 | A | | 3/1993 | Murray et al. ..... 431/12 |
| 5,317,992 | A | | 6/1994 | Joyce ..... 431/349 |
| 5,368,474 | A | | 11/1994 | Welden ..... 431/278 |
| 5,511,516 | A | | 4/1996 | Moore, Jr. et al. ..... 122/17 |
| 5,667,375 | A | | 9/1997 | Sebastiani ..... 431/75 |
| 5,791,298 | A | | 8/1998 | Rodgers ..... 122/17 |
| 5,797,355 | A | | 8/1998 | Bourke et al. |
| 5,797,358 | A | | 8/1998 | Brandt et al. |
| 5,848,586 | A | | 12/1998 | Garms ..... 122/13.01 |
| 5,918,591 | A | | 7/1999 | Vollmar et al. ..... 122/13.01 |
| 5,941,200 | A | * | 8/1999 | Boros et al. ..... 126/391.1 |
| 6,074,200 | A | | 6/2000 | Bowman et al. ..... 431/278 |
| 6,139,311 | A | | 10/2000 | Bowman et al. ..... 431/278 |

* cited by examiner

APPARATUS AND METHOD FOR SENSING FLAMMABLE VAPOR

CROSS REFERENCE TO RELATED APPLICATION

This application is a divisional patent application of patent application Ser. No. 09/307,124, filed May 7, 1999, now U.S. Pat. No. 6,139,311 which is a continuation-in-part of U.S. patent application Ser. No. 09/009,807 filed Jan. 20, 1998, now U.S. Pat. No. 6,074,200.

BACKGROUND OF THE INVENTION

1. Field of the Invention

This invention relates to an apparatus and method for sensing undesired flammable vapors at or near gaseous fuel-fired burners such as may be used for gas-fired appliances, for example residential gas-fired water heaters.

2. Description of Prior Art

Safety issues are important considerations in the design, manufacture and operation of gaseous fuel-fired burners, such as found in gas-fired appliances. This is especially true for appliances operated in a residential environment. Such appliances include residential gas-fired water heaters, gas-fired clothes dryers, furnaces, etc.

One safety issue involves a potential danger which arises when burners are exposed to flammable vapors in the ambient atmosphere external to the appliance. Such flammable vapors can cause uncontrolled propagation of flames and/or possible explosions.

An object of this invention is to provide a burner for a gas-fired appliance, capable of detecting and responding to the presence of undesired flammable vapors at, near or in the vicinity of the burner. One goal would be to turn down and/or completely shut off a gaseous fuel supply to the burner, to prevent an undesired propagation of flame and/or an explosion.

Another object of this invention is to provide a flammable vapor sensing burner which has a high degree of sensitivity to respond to even very low concentrations of detected flammable vapor.

Still another object of this invention is to provide a burner having a simplified construction with low cost, long life expectancy and enhanced durability of construction and reliability of operation.

These and other objects of this invention will become apparent in light of the present specification, the claims and the drawings.

SUMMARY OF THE INVENTION

The apparatus of this invention includes a pilot burner that operates with a main burner of a gas-fired appliance, for sensing flammable vapor present in an atmosphere ambient to the gas-fired appliance.

A first fuel gas transporting member communicates with and is connectable to a source of fuel gas. As used throughout this specification and in the claims, the phrase in communication with is intended to relate to two spaces or voids fluidically connected with or communicating with each other. The source of fuel gas may be configured for providing fuel gas, through a second fuel gas transporting member, to a main burner of the gas-fired appliance.

At least one mixer member preferably mixes fuel gas received by the first fuel gas transporting member, with air taken from the atmosphere external and ambient to the appliance, which air may contain an undesired level or amount of flammable vapor. A fuel gas-air transporting member may be operably connected to the mixer member or another suitable means for mixing fuel gas. The fuel gas-air transporting member preferably is configured for receiving the mixed fuel gas and air which may contain flammable vapor, and transporting the mixed fuel gas and air to a combustion chamber within the gas-fired appliance.

A primary pilot flame holder may be operably positionable within the combustion chamber of a gas-fired appliance. The primary pilot flame holder is preferably in communication with or operably connected to the fuel gas-air transporting member.

At least one secondary air shield preferably operates with the primary pilot flame holder, for substantially precluding access of secondary air which may be present within the combustion chamber of a gas-fired appliance, to a flame established on the primary pilot flame holder.

An igniter or another suitable ignition means is positioned near and operably associated with the at least one secondary air shield, for facilitating ignition of a main burner of a gas-fired appliance.

At least one sensor detects a change in a characteristic of a primary pilot flame established on or held by the primary pilot flame holder, such change resulting from a presence of and/or a change in an amount of, flammable vapor in the air of the atmosphere ambient to the gas-fired appliance.

The at least one sensor is sufficiently sensitive to detect a change corresponding to preselected relative amount of flammable vapor present in the air of the atmosphere ambient to the gas-fired appliance.

A controller preferably is in electrical communication with or operably associated with the at least one sensor for detecting a change in a characteristic of a flame, for controlling the operation of the source of fuel gas for a gas-fired appliance, in response to the presence of and/or the change in the amount of flammable vapor in the air of the atmosphere ambient to the gas-fired appliance. Upon demand, the controller can cease or halt the supply of fuel gas to the gas-fired appliance, for example when the at least one sensor detects a change corresponding to a threshold amount or a predetermined amount of flammable vapor in the air ambient to the gas-fired appliance.

In a preferred embodiment of this invention, the at least one mixer member for mixing fuel gas with air taken from the atmosphere external and ambient to the gas-fired appliance, which air may contain undesired flammable vapor, comprises a mixer tube positioned substantially adjacent to but spaced apart from an outlet of the first fuel gas transporting member. An inlet of the mixer tube is preferably positioned to receive a fuel gas jet from the gas nozzle. The outlet of the first fuel gas transporting member and the mixer tube are preferably operably positioned substantially external to a gas-fired appliance, so that air from the atmosphere ambient to the gas-fired appliance is entrained with the fuel gas jet from the outlet of the first fuel gas transporting member, and transported into the inlet of the mixer tube.

The at least one secondary air shield may comprise a secondary air shield, operably positioned substantially about the primary pilot flame holder, so as to substantially preclude access by secondary air within the combustion chamber of the gas-fired appliance to a pilot flame held by the primary pilot flame holder, so that any flame is substantially unaffected by any such secondary air.

The at least one sensor for detecting a change in a characteristic of a flame held by the primary pilot flame holder may comprise a thermocouple operably disposed proximate to the primary pilot flame holder for sensing the temperature at, near or in the immediate vicinity of the primary flame holder, and for providing a signal representative of the temperature which has been sensed.

In one embodiment of this invention, the controller which operates the source of fuel, in response to the presence of flammable vapor in the air ambient to the gas-fired appliance may comprise a gas valve connected directly to the thermocouple, so that as the thermocouple cools the gas valve closes.

In an alternative embodiment of this invention, the controller for controlling the operation of the source of fuel, in response to the presence of flammable vapor in the air ambient to the gas-fired appliance may comprise means for comparing the signal representative of the temperature in the immediate vicinity of the primary pilot flame holder. The means for comparing may be operably configured to compare the signal provided by the thermocouple to a predetermined range of values representative of acceptable conditions for the flame established on or held by the primary pilot flame holder. The source of fuel gas can be controlled to cease or halt the flow of fuel gas to the main burner and pilot burner when the signal provided by the thermocouple departs from a predetermined range of values representative of or corresponding to acceptable conditions for the flame held by the primary pilot flame holder.

In an alternative embodiment of this invention, in response to the presence of flammable vapor in the air ambient to the gas-fired appliance the controller may further comprise means for determining the rate of change over time of the temperature at, near or in the immediate vicinity of the primary flame holder. The determined rate of change over time of the temperature can be compared to a preselected value for the rate of change. Means may also be provided for reducing or stopping flow of the fuel gas to the main burner and/or the pilot burner when the rate of change over time of the temperature is both negative and exceeds a predetermined absolute value.

In a preferred embodiment of this invention, the at least one secondary air shield is a vertically oriented, substantially hollow cylindrical member having a primary pilot flame holder disposed at a lower end and a substantially open upper end opposite the lower end. The at least one secondary air shield can be positioned proximate the main burner flame holder of the gas-fired appliance. The means, operably associated with the at least one secondary air shield, for igniting the main burner of the gas-fired appliance comprises a secondary pilot flame holder surface, operably disposed about the substantially open upper end of the substantially hollow cylindrical member, for establishing a secondary pilot flame and for igniting fuel gas migrating from a main burner flame holder, toward establishing a main burner flame.

In another preferred embodiment of this invention, the at least one secondary air shield is a horizontally oriented, substantially hollow cylindrical member, having a primary pilot flame holder disposed at one end and a substantially closed end opposite the one end. The at least one secondary air shield can be positioned proximate the main burner flame holder of the gas-fired appliance. The means, operably associated with the at least one secondary air shield, for igniting the main burner of the gas-fired appliance may comprise a secondary pilot flame holder aperture, operably disposed in an upwardly facing region of a cylindrical side portion of the substantially hollow cylindrical member, for igniting fuel gas migrating from a main burner flame holder, toward establishing a main burner flame.

In still another preferred embodiment of this invention, the at least one secondary air shield is a substantially hollow, cylindrical member, having a primary pilot flame holder positioned at one end. The at least one secondary air shield can be positioned proximate the main burner flame holder of the gas-fired appliance. The means, operably associated with the at least one secondary air shield member, for igniting the main burner of the gas-fired appliance comprises at least one flash tube member, operably associated with or in communication with the substantially hollow cylindrical member, for receiving fuel gas from a main burner flame holder and for conducting the fuel gas toward a primary pilot flame held by the primary pilot flame holder, toward igniting the fuel gas from the main burner flame holder and thus establishing the main burner flame.

This invention also relates to a method for sensing flammable vapor present in the atmosphere ambient to the gas-fired appliance, and for controlling operation of the gas-fired appliance in response to a presence of or an undesired level of a flammable vapor.

A first fuel gas transporting member is connected to or communicates with a source of fuel gas. The source of fuel gas can be configured to provide fuel gas through a second fuel gas transporting member, to the main burner of the gas-fired appliance. Fuel gas received by the first fuel gas transporting member is mixed, using least one mixer member, with air taken from the atmosphere external and ambient to the appliance, which air may contain flammable vapor.

The mixed fuel gas and air is transported or flows to a combustion chamber within the gas-fired appliance, such as through a fuel gas-air transporting member. A primary pilot flame holder operably positionable within the combustion chamber of the gas-fired appliance is connected to or communicates with the fuel gas-air transporting member.

At least one secondary air shield is used to substantially preclude access of secondary air which may be present within the combustion chamber of the gas-fired appliance to the flame established on or held by the primary pilot flame holder.

At least one sensor is used to detect a change in a characteristic of a flame held by the primary pilot flame holder, such change resulting from the presence of and/or the change in the amount of flammable vapor in the air from the atmosphere ambient to the gas-fired appliance. The change corresponds to a preselected relative amount of flammable vapor present in the air from the atmosphere ambient to the gas-fired appliance.

A controller is used to control the operation of the source of fuel gas for a gas-fired appliance, in response to the presence of and/or the change in the amount of flammable vapor in the air from the atmosphere ambient to the gas-fired appliance. The supply of the fuel gas to the gas-fired appliance is ceased or halted when the at least one sensor detects a change corresponding to a predetermined amount of flammable vapor in the air ambient to the gas-fired appliance.

In one preferred embodiment, a mixer tube is positioned substantially adjacent to but also spaced apart from an outlet of the first fuel gas transporting member. An inlet of the mixer tube can be positioned to receive the fuel gas jet from the gas nozzle.

The outlet of the first fuel gas transporting member and the mixer tube is preferably positioned substantially external to the gas-fired appliance, so that air from the atmosphere ambient to the gas-fired appliance is entrained with the fuel gas jet from the outlet of the first fuel gas transporting member, and directed or transported into the inlet of the mixer tube.

A secondary air shield can be positioned substantially about the primary pilot flame holder, so as to substantially preclude access of secondary air within the combustion chamber of the gas-fired appliance to the pilot flame established on or held by the primary pilot flame holder, so that the pilot flame is substantially unaffected by any such secondary air.

A thermocouple can be positioned proximate to the primary pilot flame holder for sensing the temperature at, near or in the immediate vicinity of the primary pilot flame holder, and for providing a signal representative of the temperature of the immediate vicinity of the primary pilot flame holder.

The thermocouple can be connected directly to a gas valve, so that as the thermocouple cools and reaches a certain level the gas valve then closes.

The signal representative of the temperature at, near or in the immediate vicinity of the primary pilot flame holder is preferably compared to a predetermined range of values representative of or corresponding to acceptable conditions for the flame held by the primary pilot flame holder.

The source of the fuel gas ceases or halts fuel gas flow to the main burner and/or the pilot burner when the signal provided by the thermocouple departs from or is different than the predetermined range of values.

The rate of change overtime of the temperature at, near or in the immediate vicinity of the primary flame holder is determined and compared to a preselected value for the rate of change over time, of the temperature.

The source of the fuel gas then ceases or halts fuel gas flow to the main burner and/or the pilot burner preferably when the rate of change over time of the temperature is both negative and exceeds a predetermined absolute value.

DESCRIPTION OF PREFERRED EMBODIMENTS

While this invention is susceptible of embodiments in many different forms, the drawings show and the specification describes specific embodiments with the understanding that the present disclosure is intended to not limit this invention to the embodiments illustrated.

Concentrations of flammable vapor in air, well below a flammable vapor's Lower Flammability Limit (LFL), alter the designed air-to-fuel ratio of any partially or fully premixed gas burner. Alterations in the air-to-fuel ratio of a pre-mixed burner affect several flame characteristics, including but not limited to: flame position relative to the burner, including partial or complete flame lift-off; flame shape; flame temperature; and flame ionization level. These premixed burner flame characteristics can be sensed by a number of methods including but not limited to use of: at least one thermocouple to sense temperature or to sense flame position and shape; at least one flame ionization detector to sense the degree of flame ionization; at least one photodiode to sense flame position and shape; and/or at least one ultra-violet sensor to sense flame temperature and/or degree of ionization. A change in any one or more of the above-identified flame characteristics can be correlated to a change in the air-to-fuel ratio for a premixed burner, such as resulting from the presence of flammable vapor in the ambient air. If through such correlation it is detected that the air-to-fuel ratio has changed beyond the range of normal operation variation for the particular installation, then gas flow may be completely shut off to the gas-fired appliance. Promptly shutting off the gas flow, if done before the flammable vapors reach their lower flammability limit, should prevent ignition of the flammable vapor by each burner of the gas-fired appliance.

Figure 1:
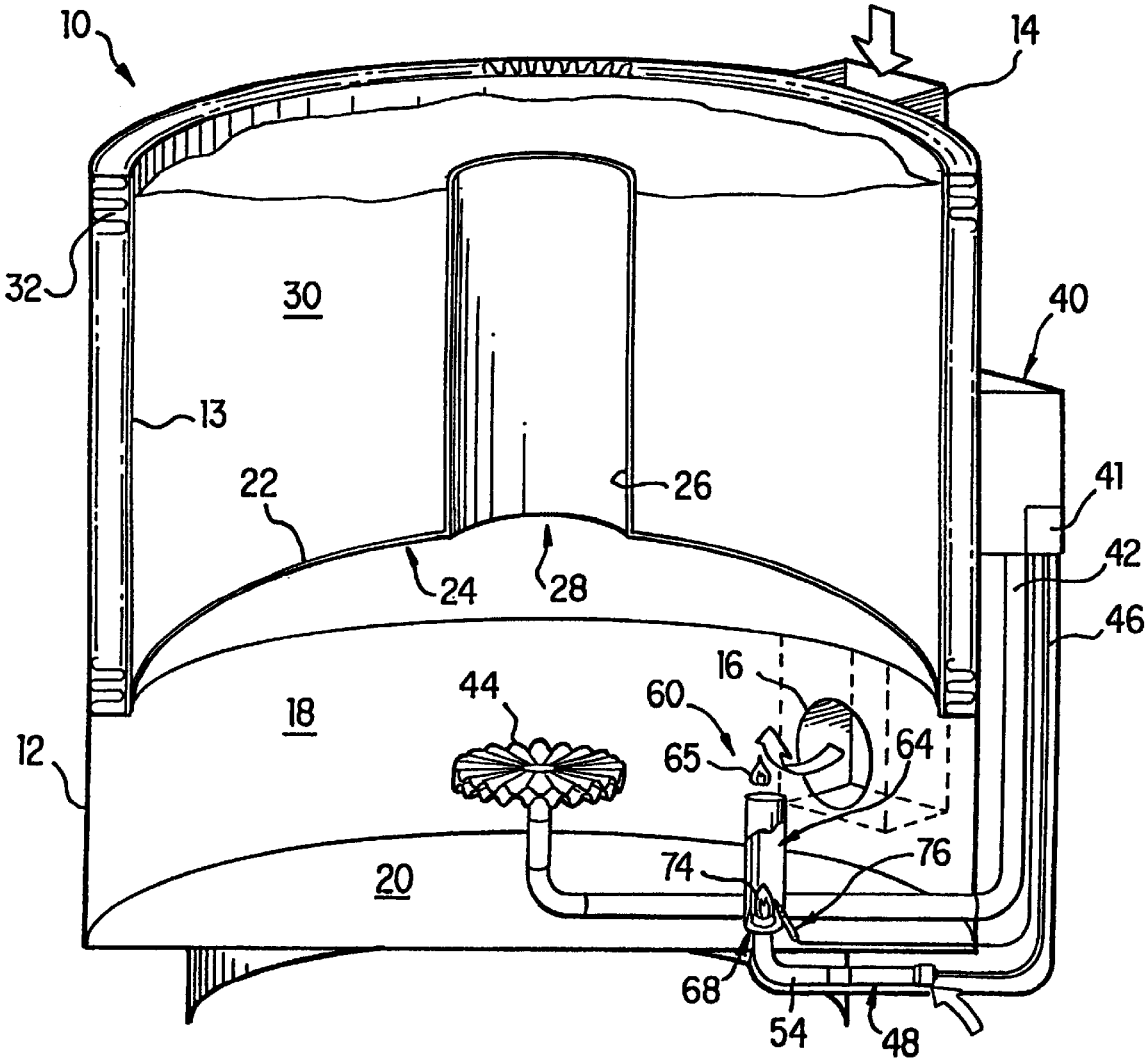
FIG. 1 is a fragmentary sectional schematic view of a flammable vapor sensing pilot burner apparatus according to one preferred embodiment of this invention, in an environment of a burner for a gas-fired water heater.
Figure 2:
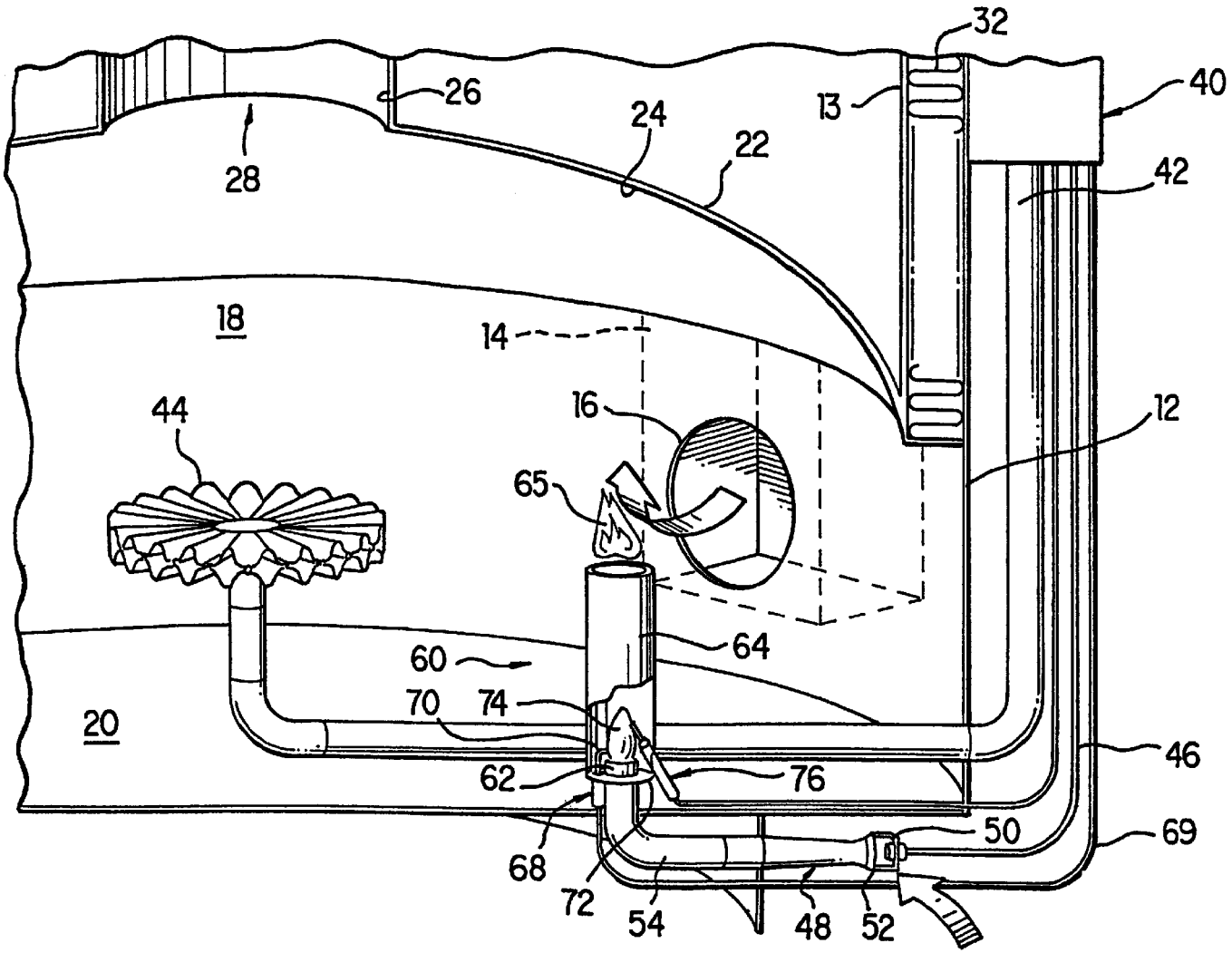
FIG. 2 is an enlarged fragmentary sectional schematic view of the apparatus shown in FIG. 1.

Pilot burner apparatus 60 of this invention, as shown in FIGS. 1 and 2, can replace the diffusion flame pilot burner typically found in a conventional gas-fired water heater. Pilot burner apparatus 60 includes a partially pre-mixed pilot burner which senses and responds to small changes in air-to-fuel ratios as a result of the presence of flammable vapor in the ambient air surrounding the appliance. Pilot burner apparatus 60 also performs one function of a traditional pilot, by heating a thermocouple to energize a gas safety valve used to ignite the main burner.

A partially pre-mixed pilot burner is an important element of the pilot burner apparatus and process of this invention. To effectively employ the apparatus and process of this invention, the air flow to the pre-mixed pilot burner should be well managed and controlled. The primary air intake of the pre-mixed pilot burner should be exposed to or in communication, direct or indirect, with the air source which may potentially contain flammable vapor. However, to achieve sensitivity to low flammable vapor levels, the actual flame of the pre-mixed pilot burner should be shielded from any air source.

The air source that may potentially contain a flammable vapor or a threshold level of a flammable vapor can be found in many different locations. The air source for the pilot burner is preferably at or near a particular zone within an environment that may contain an undesired flammable vapor. Undesired flammable vapors can result from accidental spills, leaking containers holding a flammable vapor source, an open container holding a flammable vapor source, or any other potential hazard that can produce a flammable vapor within the particular environment. The apparatus and method according to this invention is particularly suitable for use with a water heater that is positioned on a floor of a room. One common type of spill results in a liquid fuel or a gaseous fuel spreading over an exposed surface area of the floor. In such condition, the undesired flammable vapors often have a molecular weight greater than the molecular weight of air and thus gravitate toward and remain close to the floor surface. However, it is apparent that many other types of spills, leaks or other conditions which produce undesired flammable vapors can result in the flammable vapor traveling at different altitudes within a room.

FIGS. 1 and 2 illustrate, somewhat schematically, a burner, in section, employing a pilot burner apparatus in accordance with this invention, for example as may be used in a residential gas-fired appliance, such as a water heater.

As shown in FIG. 1, gas-fired appliance 10, such as a water heater, comprises shell 12. On an outside surface of shell 12 air duct 14 is mounted, preferably but not necessarily in a sealed manner. Opening 16 in a side wall of shell 12 permits ambient air to flow through or be conducted into combustion chamber 18. As shown in FIG. 1, the construction of shell 12 is simplified, for purposes of this application. Typically, shell 12 has a reinforced supporting bottom structure, for enabling shell 12 to carry or withstand the load of the weight of the water in a filled water heater tank. Combustion chamber 18 is defined in part by the vertical walls of shell 12, bottom pan 20, and insert 22 which forms an upwardly convex wall 24 and a central cylindrical tube 26 providing passage 28. In the embodiment of a water heater, shell 12 also forms in part walls of the water heater, and region 30 above insert 22, as shown in FIG. 1 is a region for containing the water to be heated. Tube 26 will, preferably, extend completely through to a top portion of shell 12 (not shown) to provide a chimney for discharging combustion products from combustion chamber 18. In the region of shell 12 above the periphery of insert 22, inner wall 13 preferably has insulation 32, for example fiberglass batt, positioned between shell 12 and inner wall 13.

Air duct 14 may be formed as a generally rectangular structure, with an opening at a top portion for communicating with ambient air. Preferably, air duct 14 is long enough so that its opening is elevated sufficiently above floor level so that most volatile vapors which may be encountered (e.g., in a basement, such as paint thinner fumes, etc.) will be delayed in rising or will not rise high enough to enter into air duct 14. Thus, the combustion air supplied directly from ambient to combustion chamber 18 will not, in ordinary circumstances, be contaminated with undesired flammable vapors, as may the air which is entrained in the pilot fuel/air flow, as described in further detail.

Gas valve 40 is preferably mounted on an outside surface of shell 12 and is connected to a supply of gaseous fuel (not shown) in a conventional manner. Gas valve 40 may have any other suitable conventional configuration, apart from modifications as described according to this invention, in order to enable gas valve 40 to be actuated in accordance with the principles of this invention.

Figure 11:
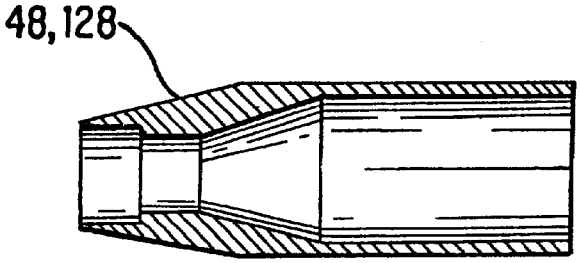
FIG. 11 is a cross-sectional view of a venturi nozzle of a mixer tube such as shown in FIG. 10, according to one preferred embodiment of this invention.

Gas tube 42 is connected to gas valve 40 and routed into combustion chamber 18. Flame holder 44 is supported atop an end portion of gas tube 42 to act as a flame holder for the main burner of gas-fired appliance 10. Pilot gas tube 46 directs or carries gaseous fuel to mixer 48, which preferably but not necessarily has a venturi configuration, for expansion of the mixed gases. FIG. 11 shows a cross-sectional view of one preferred venturi configuration of mixer tube 48. As shown in FIG. 2, one end portion of pilot gas tube 46 terminates at nozzle 50 which is spaced apart from inlet 52 to mixer tube 48. In one preferred embodiment of this invention, inlet 52 and pilot gas tube nozzle 50 are positioned external with respect to shell 12 and external with respect to and removed from the inlet to air duct 14, to form communication with the ambient atmosphere immediately outside of and preferably near the bottom of gas-fired appliance 10, preferably but not necessarily, as close to the floor as possible. The positioning of the connection between nozzle 50 and inlet 52 as shown in FIG. 2, should be carefully considered because except for certain gases such as hydrogen, methane and ethane, most combustion gases which are likely to be found in a residential environment (especially, for example, in a basement) are substantially heavier than the gases which make up the ambient atmosphere and will tend to gravitate toward the lowest point in the occupied space, e.g., the floor.

Mixer tube 48 connects to pilot gas tube 54 which is routed or extends into combustion chamber 18 and supports pilot burner apparatus 60. Although mixer tube 48 and pilot gas tube 54 are shown as two separate components, it is also possible to form them as one piece or a unitary structure. Pilot burner apparatus 60 comprises primary flame holder 62, which can be a perforated plate type of flame holder, and secondary air shield 64. Piezo-igniter electrode 68, which may be of any other suitable conventional configuration, may be supported adjacent primary flame holder 62, so that tip 70, as shown in FIG. 2, is relatively close to primary flame holder 62. For example, piezo-igniter electrode 68 may be supported on flange 72, as shown in FIG. 2, surrounding primary flame holder 62. Alternatively, electrode 68 may be positioned adjacent the outlet of secondary air shield 64. Flame holder 62 preferably is a cylindrical perforated disk which is positioned in an end portion of shield 64, such as perpendicular to an axis of secondary air shield 64 and occupying the complete inner diameter of the inlet end of secondary air shield 64.

Typically, of pilot burner 60 is ignited by supplying a desired amount of gaseous fuel through pilot gas tube 46 and ultimately discharged through primary flame holder 62 as a fuel/air mixture. Combustion air, from the ambient air surrounding the appliance, mixes with a fuel jet discharged from nozzle 50 and is entrained with the fuel jet and enters inlet 52 of tube 48. The mixed fuel gas and combustion air discharges from pilot gas tube 54, at primary flame holder 62. An electrical potential is then applied to piezo-igniter electrode 68, such as through wire 69, as shown in FIG. 2, until a spark arcs from tip 70 to the surface of primary flame holder 62, igniting the gases and creating flame 74, as shown in FIG. 2. Thermocouple 76 preferably is likewise supported on flange 72 so that tip 78 of thermocouple 76 contacts or extends into flame 74.

A second flame body 65 can form the upper end of secondary air shield 64, as shown in FIG. 2, and as later described.

Once a satisfactory flame 74 is established in pilot burner apparatus 60, gas valve 40 supplies fuel gas to flame holder 44 via gas tube 42. After a sufficient amount of combustible gas has occupied the space surrounding flame holder 44, flame 65 will propagate and ignite the gases surrounding flame holder 44. In a preferred embodiment of this invention, main flame holder 44 may be any suitable conventional flame holder, such as found in conventional gas-fired water heaters.

Figure 3:
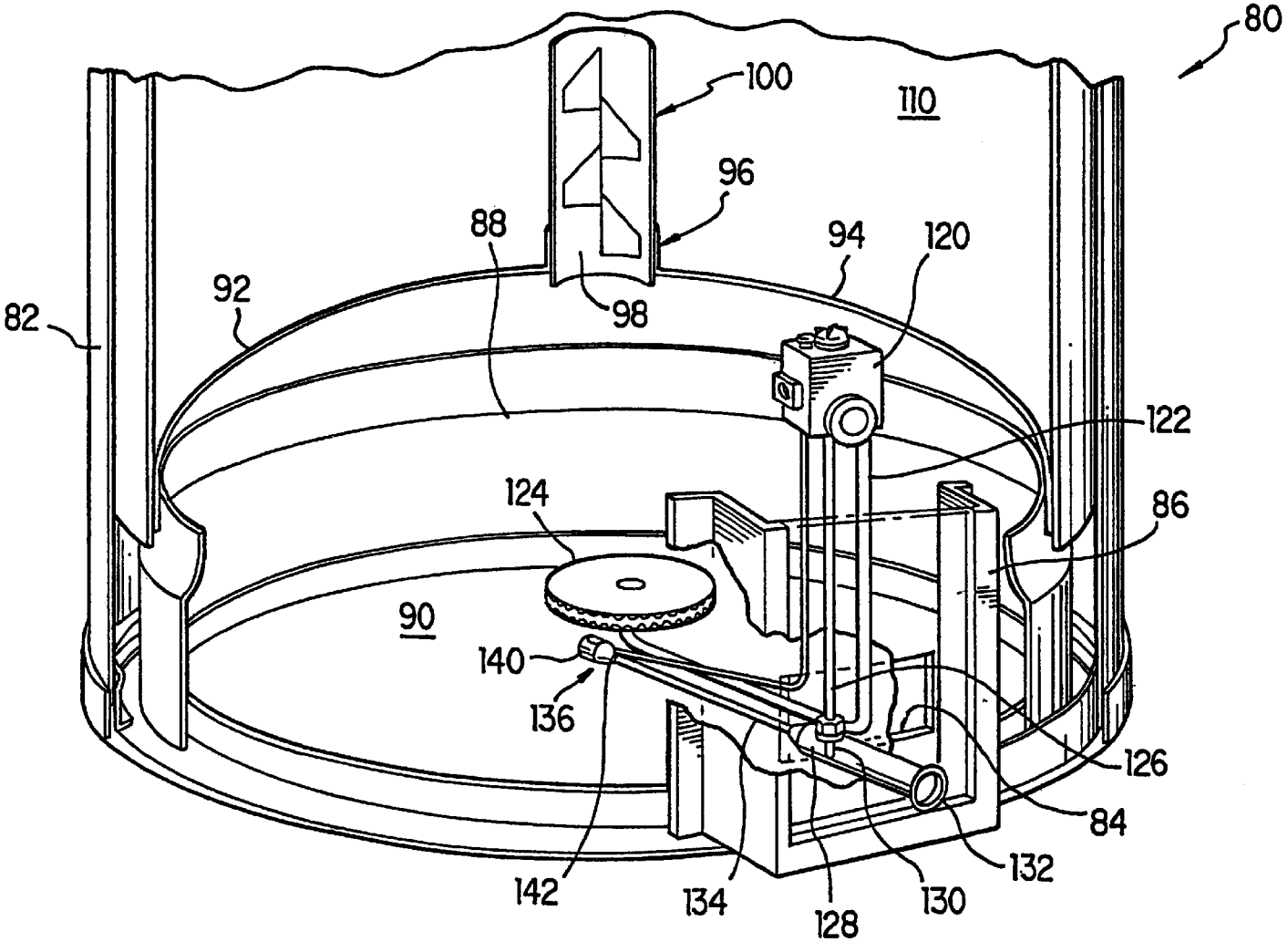
FIG. 3 is an enlarged fragmentary sectional schematic view of another preferred embodiment of the apparatus of this invention.

FIG. 3 illustrates an alternative preferred embodiment of the apparatus of this invention. Gas-fired appliance 80, e.g., a water heater, comprises shell 82 having through opening 84 which is surrounded by air dam 86. Air dam 86, shown in FIG. 3 partially in fragment, to show inner components, preferably is, like the prior embodiments, configured as a rectangular chute, with an open top exposed to ambient air, so that ambient air from some height above the floor and/or above the air opening that supplies air to the pilot flame, flows through the passage of air dam 86, to within combustion chamber 88.

In another preferred embodiment according to this invention, ambient air or other oxidant that enters the combustion chamber in a shutdown condition, such as which causes gas valve 120 to close and shutdown the main combustion burner, preferably comes from an environment significantly different than the environment near the air opening which supplies air to the pilot flame. The phrase significantly different environment is intended to relate to a first environment that has a first concentration of undesired flammable vapors that is significantly different than a second concentration of undesired flammable vapors of a second environment. The phrase significantly different environment can also relate to a rate of change of the first concentration of undesired flammable vapors of the first environment that is significantly different than a rate of change of the second concentration of undesired flammable vapors of the second environment. For example, it may be possible to close the top of air dam 86 and then form communication between the interior space defined by air dam 86 and the other significantly different environment such as an environment of another room, of the outdoors, of a pressurized tank or of any other suitable air or other oxidant source that may be exposed to undesired flammable vapors.

Combustion chamber 88 is defined in part by the vertical walls of shell 82, bottom pan 90, and insert 92 which forms an upwardly convex wall 94 and a central cylindrical tube 96 providing passage 98. Tube 96 can be connected to chimney 100, providing both a discharge path for of combustion products as well as a location for heat exchange with the surrounding water reservoir. In the embodiment of a water heater, shell 82 also forms in part the walls of the water heater, and region 110 above insert 92, in which the water to be heated is contained.

Gas valve 120 is preferably mounted on the outside surface of shell 82 and is connected to a supply of gaseous fuel in a conventional manner. Gas valve 120 may be of any other suitable known configuration, apart from modifications of this invention, in order to actuate gas valve 120.

Gas tube 122 is connected to gas valve 120 and routed into combustion chamber 88. Flame holder 124 is supported atop an end portion of gas tube 122 to act as a flame holder for the main burner of gas-fired appliance 80. Pilot gas tube 126 directs or carries gaseous fuel to mixer tube 128, which preferably has a venturi configuration, for expansion of the mixed gases. One end portion of pilot gas tube 126 terminates at nozzle 130 which projects into mixer tube 128. Mixer tube 128 has, at an outer end, an opening 132 in a wall of air dam 86. The orifice of nozzle 130 points in a downstream direction along pipe 134, toward secondary air shield 140. FIGS. 7–10 and 16 also show preferred orientation of nozzle 130 with respect to mixer tube 128. Accordingly, the fuel gas jet draws ambient air into opening 132, and entrains the ambient air into the fuel gas jet.

The positioning of the orifice of nozzle 130 is important, because except for certain gases such as hydrogen, methane and ethane, most combustible gases which are likely to be found in a residential environment (especially, for example, in a basement) are substantially heavier than the gases which make up the ambient atmosphere and so will tend to gravitate toward the lowest point in the occupied space, e.g., the floor. In an alternative configuration, opening 130 may be placed in the bottom wall of air dam 86 or in another significantly different environment, as previously described.

Figure 8:
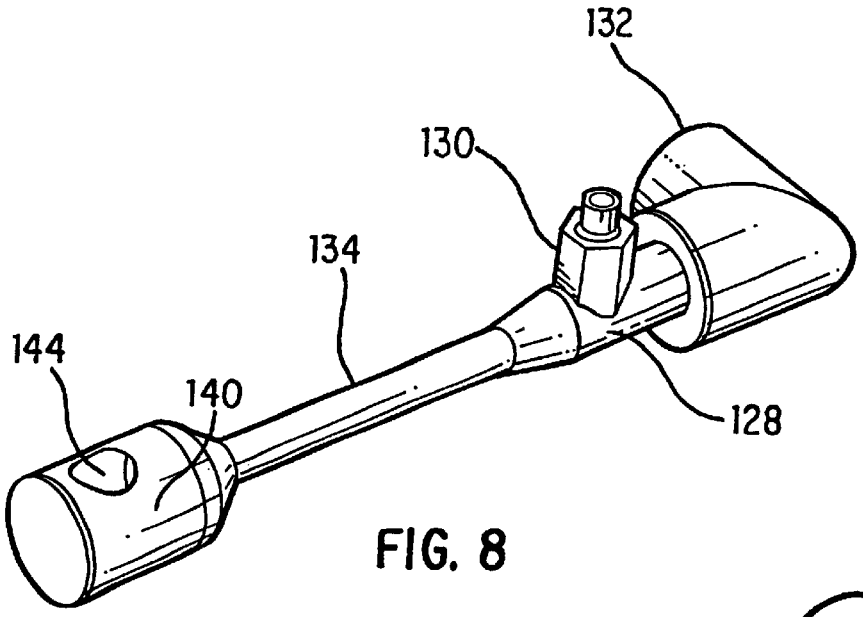
FIG. 8 is a perspective view of a flammable vapor sensing pilot burner assembly, according to one preferred embodiment of this invention.
Figure 9:
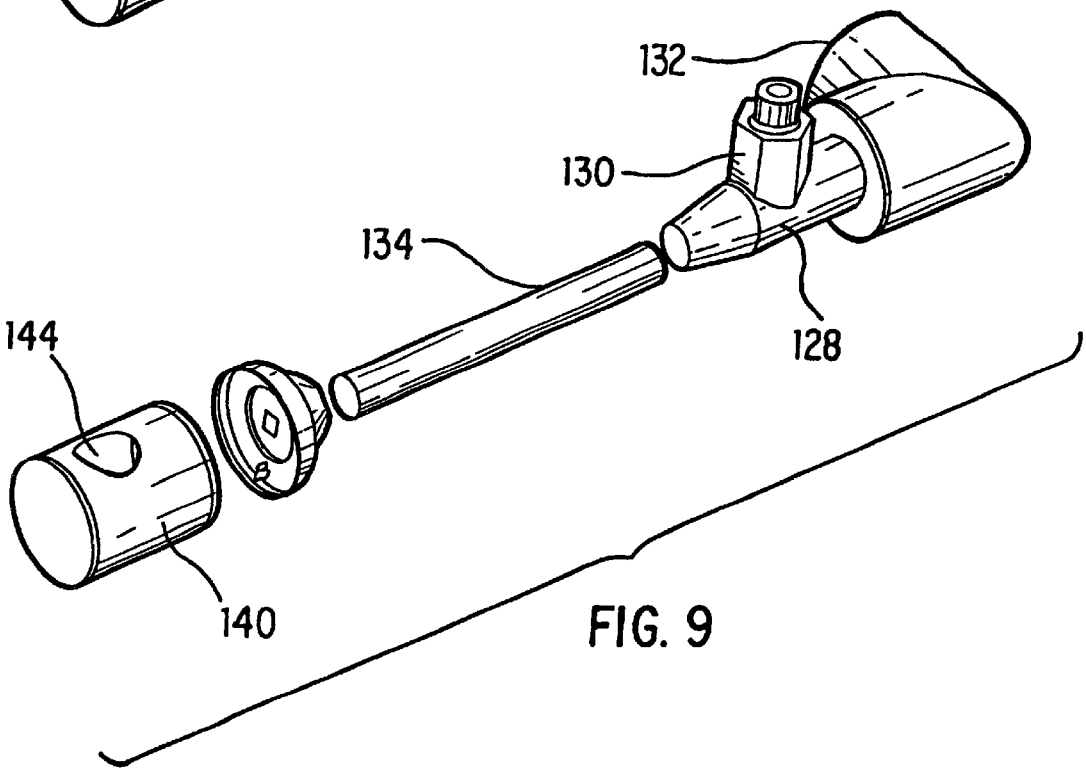
FIG. 9 is a perspective exploded view of the flammable vapor sensing pilot burner assembly, as shown in FIG. 8.
Figure 10:
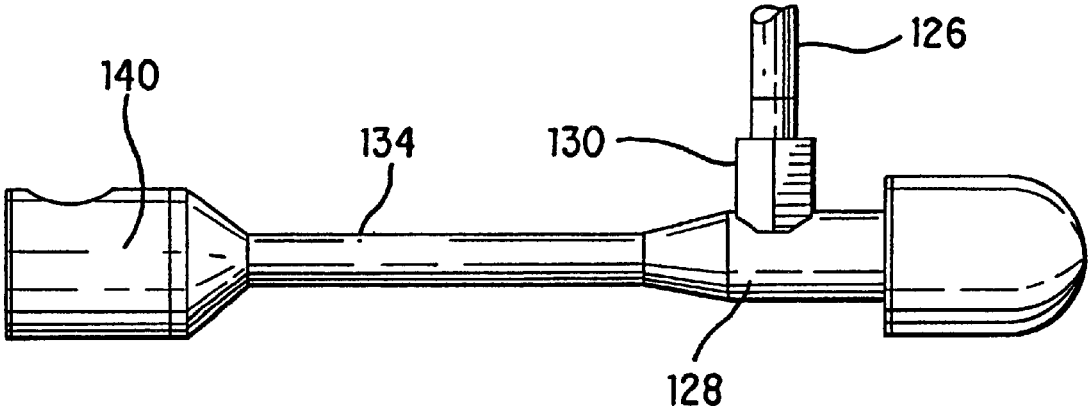
FIG. 10 is a front view of the flammable vapor sensing pilot burner assembly, as shown in FIG. 8.

Mixer tube 128 connects to and communicates with pilot gas tube 134 which extends into combustion chamber 88 and supports pilot burner apparatus 136, including secondary air shield 140. Although mixer tube 128 and pilot gas tube 134 are shown as two separate components, it is also possible to form one piece or a unitary structure. Pilot burner apparatus 136 comprises a primary flame holder, not shown in FIG. 3, which is preferably a perforated plate type of flame holder. The primary flame holder is preferably a disc-shaped flame holder as previously described. However, rather than being mounted facing upward, the flame holder is mounted around a horizontal axis, inside the secondary air shield. Thermocouple 142 extends into secondary air shield 140, for sensing the presence, temperature and/or other condition of a flame within secondary air shield 140, in a manner substantially the same as described with respect to the embodiments of FIGS. 1 and 2. Secondary air shield 140 is a horizontally extending hollow cylinder or tubular member, having one end connected to tube 134, and having the opposite end closed. A round aperture 144 is positioned in the side of secondary air shield 140, facing upward, to permit the exit of unburned fuel gas, combustion byproducts, and flame. FIGS. 8–10 show another preferred embodiment of secondary air shield 140, according to this invention.

Aside from the specific structural differences described and illustrated, the pilot burner apparatus of FIG. 3 is configured and operates in a substantially similar manner as the pilot burner apparatus of FIGS. 1 and 2.

Figure 5:
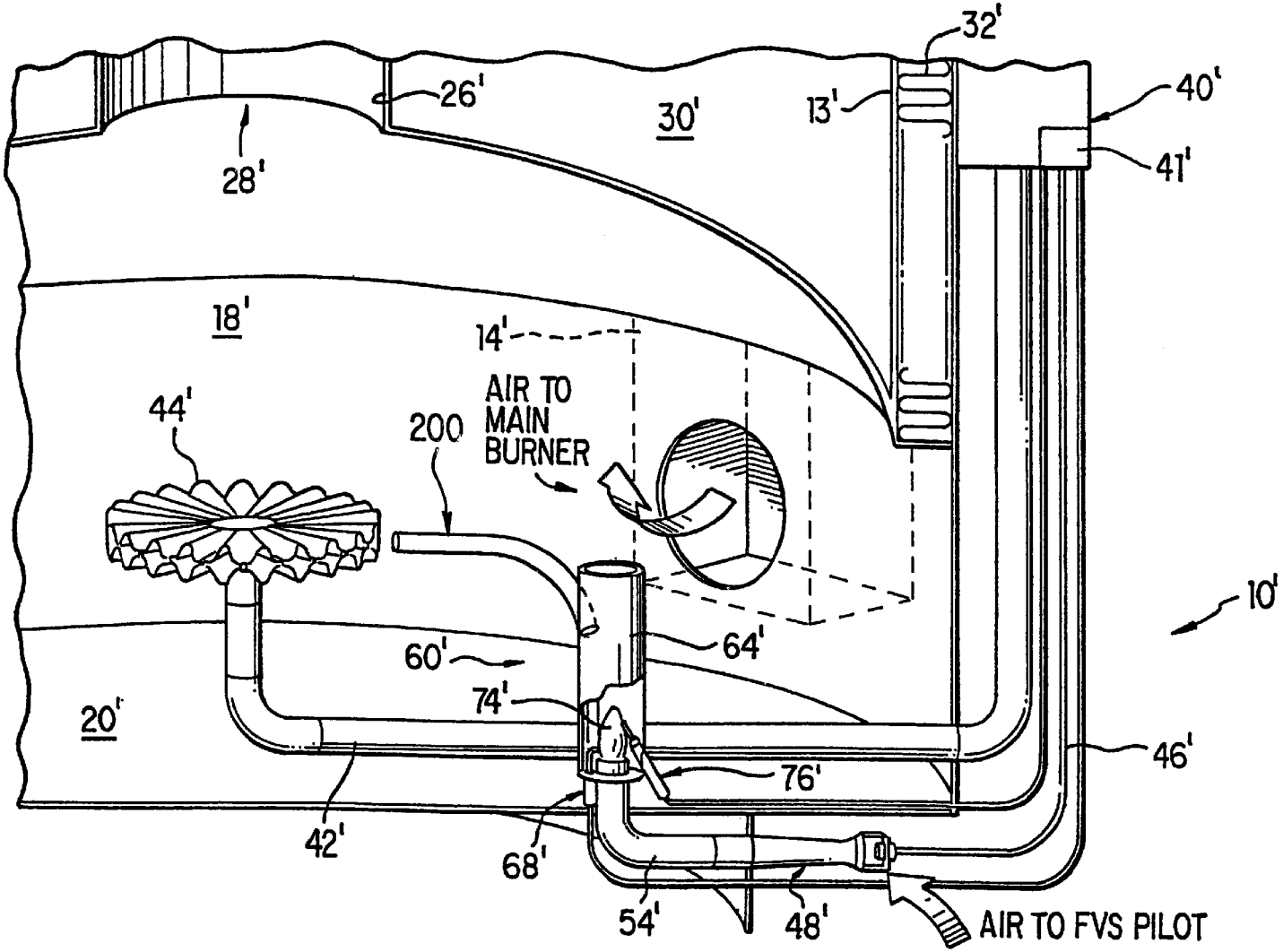
FIG. 5 is an enlarged sectional fragmentary schematic view of a flammable vapor sensing pilot burner apparatus, according to another preferred embodiment of this invention.

FIG. 5 is an enlarged sectional fragmentary schematic view of a flammable vapor sensing pilot burner apparatus according to another preferred embodiment of this invention. The apparatus of FIG. 5 is substantially similar to the configuration of the embodiment of FIGS. 1 and 2, and accordingly, elements having similar structures and functions as the apparatus of FIGS. 1 and 2 have a corresponding element reference numeral but with a prime (′). The apparatus of FIG. 5 has a flash tube 200, extending from secondary air shield 64′ toward main flame holder 44′. Flash tube 200 ignites the main flame at flame holder 44′, like flash tubes in conventional pilot burner configurations. As fuel gas discharges from the main burner flame holder, some fuel gas is directed into and travels down the flash tube, where it is ignited by the primary pilot flame. Then, the flame flashes up the tube to the main burner flame holder.

Apart from certain specific structural details of the several embodiments, the basic operating principles of the flammable vapor sensing pilot burners of the several embodiments are similar or the same, relative to the vapor sensing and control functions.

The pre-mixed pilot burners employed in this invention use secondary air shields, such as secondary air shield 64, to ensure that the primary pilot flame is not exposed to a secondary air source. The geometry of the secondary air shields and that of the primary pilot flame holders (e.g., primary flame holder 62 and flange 72) are optimized together to achieve a balance between flammable vapor sensitivity and pilot flame stability.

The size, shape and configuration of the primary flame holder and the secondary air shield, in each of the embodiments, are selected to provide a stable pre-mixed flame with an equivalence ratio $\phi$ (ratio of fuel/air actual to fuel/air stoichiometric) of approximately 1.3 under normal operating conditions. The approximate value for the equivalence ratio $\phi$ is selected for two reasons: 1) it is likely more difficult to entrain sufficient primary air to operate an atmospheric, pre-mixed burner leaner or nearer to stoichiometric; and 2) the upper flammability limit for natural gas is approximately at $\phi$ equal to 1.7, and operating closer to this limit is likely to promote a tendency toward flame lift off.

Although several flame characteristics, as described previously, can be correlated to an air-to-fuel-ratio indicative of the presence of flammable vapor, the system of this invention preferably uses one or more thermocouples to sense changes in a position, a shape and/or a temperature of the flame. Using one or more thermocouples for sensing flammable vapor makes the system self-powered and compatible with existing gas safety valves.

In one preferred embodiment of this invention, a thermocouple millivolt output may be connected directly to the gas valve solenoid. After the pilot flame is established, such as by an operator depressing a conventional start button, which typically literally pushes the valve solenoid to an open position, and igniting the gas, the thermocouple begins producing an output voltage, which holds the solenoid open against a spring force. If the pilot flame lifts off, the thermocouple cools, the voltage drops until the solenoid spring force cannot be overcome, and the valve closes, cutting off all gas flow preferably to both pilot and main burners.

In conjunction with this operation, air ducts or air dams have elevated openings to ambient air. The elevated openings for the air for the main burners, provide a "delay," because flammable vapors will be sensed by the pilot first, and before the flammable vapors rise to the level of the opening of the duct or dam, the sensing action of the pilot occur, leading to the shut off of the gas.

In another preferred embodiment, the thermocouple may be connected in series to a control unit, such as control unit 41 shown in FIG. 1, which may be a microprocessor or another similar device, suitably configured to monitor the voltage output of the thermocouple, and compare such voltage values, over time, to data stored in the control unit which correspond to voltage values representative of desired, or at least nominal satisfactory function of the burner. The control unit can be suitably associated with the gas valve for the gas-fired appliance, so that the control unit may condition the voltage output of the thermocouple, to accelerate the process of closing the gas valve, once the control unit has determined that flammable vapor conditions exist. The thermocouple output voltage may still be high enough to otherwise hold the gas valve open, but if the voltage changes reflect lift off or imminent lift off of the primary pilot flame, the control unit will cut off or clip the output voltage, so that the gas valve closes immediately.

If the air ambient to the appliance, which is as combustion air at the pilot air inlet, contains flammable vapor, then the characteristics of the primary pilot flame situated above the primary pilot flame holder will change, and the flame will become unstable. Ultimately, as the level of flammable vapor increases, the primary pilot flame will eventually lift off of the primary pilot flame holder and move to the top, or upper opening, of the secondary air shield, similar to the embodiments of FIGS. 1–3, so that the primary and secondary pilot flames will become superimposed. The operation of the embodiment of FIG. 5 is slightly different, due to the presence of flash tube 200. When flash tube 200 is present, a secondary pilot flame may or may not be stabilized at the top of secondary air shield 64′. The pilot burner may include a primary pilot flame holder (not shown) which may be substantially the same as in the embodiments shown in FIGS. 1–3. However, in the embodiment of FIG. 5, when the flammable vapor content of the ambient air exceeds the designed upper limit, then the primary pilot flame will simply lift off and move to the end of the secondary air shield.

Figure 4:
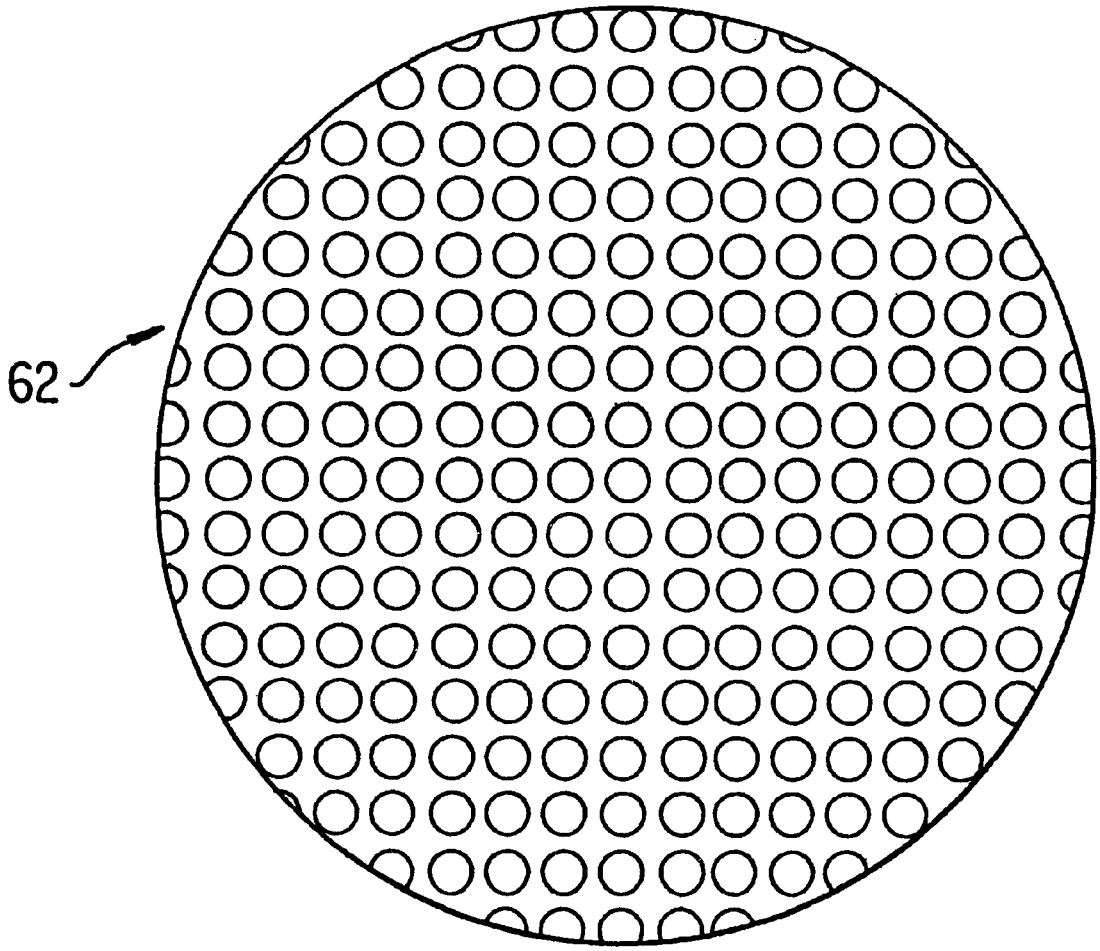
FIG. 4 is an enlarged fragmentary plan view of a portion of a primary flame holder according to a preferred embodiment of the invention.

To control the value of $\phi$ at which the primary pilot flame lifts off and to ensure overall performance of the flammable vapor sensing system of this invention, several design parameters for the primary flame holder should be considered. These design parameters include but are not limited to: 1) the flame holder port size; 2) the number of ports or flame holder surface open area; 3) the port pattern; and/or 4) the flame holder thickness. FIG. 4 is an enlarged fragmentary plan view of a portion of a primary flame holder according to this invention. Although flame holder 62 is shown and discussed, it is understood that the following discussion applies equally to the flame holders of all embodiments of this invention. Certain minor variations in design, readily obtainable by one of ordinary skill in the art having the present disclosure before them, may be necessary and appropriate when moving from one embodiment to the next, depending upon the specific appliance application.

As shown in FIG. 4, primary flame holder 62 preferably is a flat cylindrical perforated disk. Dimensions or values discussed in this specification are approximate dimensions or values. The port size of the primary flame holder can be limited to prevent flashback through the primary flame holder. The major characteristic dimension, such as diameter or slot width, of a port should be less than 0.030", generally. Further, for loadings as described, port diameters greater than 0.030" to 0.040" are believed to be prone to flashback. Port density or open area in the primary flame holder is set to achieve burner port loadings in the range of 3,000 to 6,000 Btu/hr/in$^2$. For a firing rate of 500 Btu/hr, the open area of the primary flame holder ranges from 0.0833 in$^2$ to 0.1666 in$^2$. Higher port loadings make the primary flame holder more sensitive to increases in $\phi$ above the nominal set point of 1.3. Therefore, higher port loadings make the flammable vapor sensing pilot burner system of this invention sensitive to lower concentrations of flammable vapor. Conversely, higher port loadings also make the primary pilot flame less stable under normal operating conditions.

The thickness of the primary flame holder can influence the lift off point for a given port loading. A thicker primary flame holder will tend to be less stable under normal operating conditions. Preferably, the primary flame holder thickness will be in the range of 0.02"–0.05".

In a preferred embodiment of this invention, the primary flame holder will have a uniform 44% open area pattern with 0.03" diameter holes and a port loading of 3300 BTUH/in$^2$. Other dimensions of a preferred primary flame holder are shown in FIG. 4. Preferably, a uniform rectangular pattern of circular perforation is used for the ports.

The secondary air shield is preferably a hollow cylinder or tubular member, at least in its external configuration. The following characteristics of the secondary air shield should require consideration: the inner diameter; the taper of the inner diameter; the length of the secondary air shield; and the exit orientation of unburnt gases and combustion products. For firing rates and port loadings previously described, inner diameters of approximately 0.75" and 1.0" were tested. It is believed that a 1.0" diameter is preferable, because it is believed that a 0.75" diameter increases the instability of the flame under most conditions and may make ignition of the primary pilot flame very difficult.

Tapering the inner diameter from 1.0" at the base, does not substantially affect acceleration of lift off once lift off begins which is a desirable trait. Reducing the inner diameter of the secondary air shield 64 near a plane at which unburnt gases and combustion products discharge from the secondary air shield promotes formation of secondary pilot flame 65. The secondary pilot flame ignites the main burner flame. The secondary pilot flame also burns unburnt gases exiting the primary pilot flame 74 and provides visual confirmation that the pilot is successfully lit.

The length of the secondary air shield was varied from 1.0" to 3.0" to examine the effect upon stability, lift off, and ignition of the primary pilot flame 74, and the stability and ignition of the secondary pilot flame. A preferred length of the secondary air shield 64 is believed to be approximately 1.0". Increasing the length, appears to decrease the stability and ignition reliability of the secondary pilot flame. The ignition reliability of the secondary pilot flame appears to depend primarily on the temperature of the unburnt gases exiting secondary air shield 64 being above an autoignition temperature of the gases in standard air. Increasing the length of secondary air shield 64 increases the area for the unburnt gases to transfer heat to the ambient, thereby decreasing the temperature of the unburnt gases.

Figure 6:
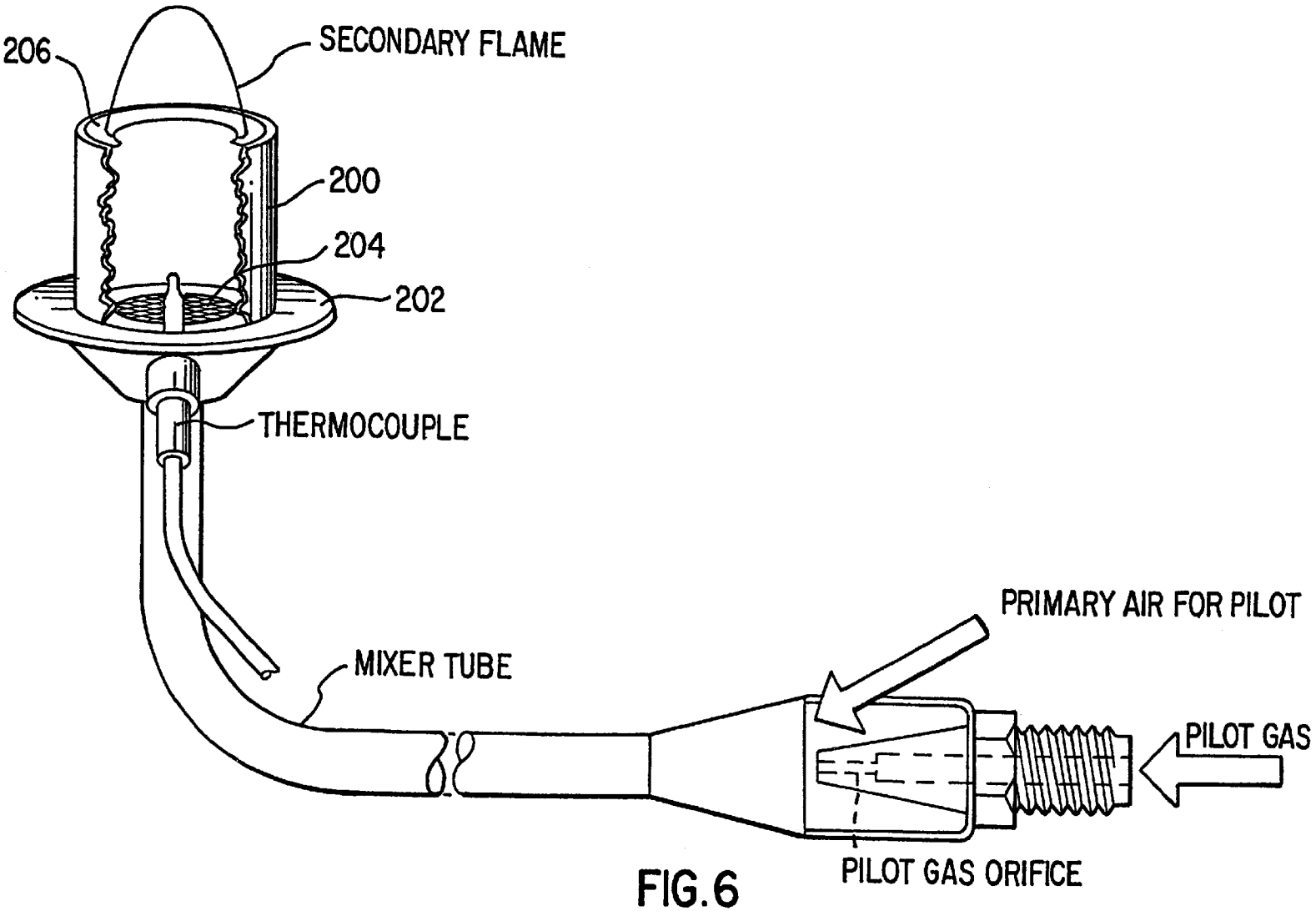
FIG. 6 is an enlarged partial sectional front view of a pilot burner having a vertically oriented secondary air shield.
Figure 7:
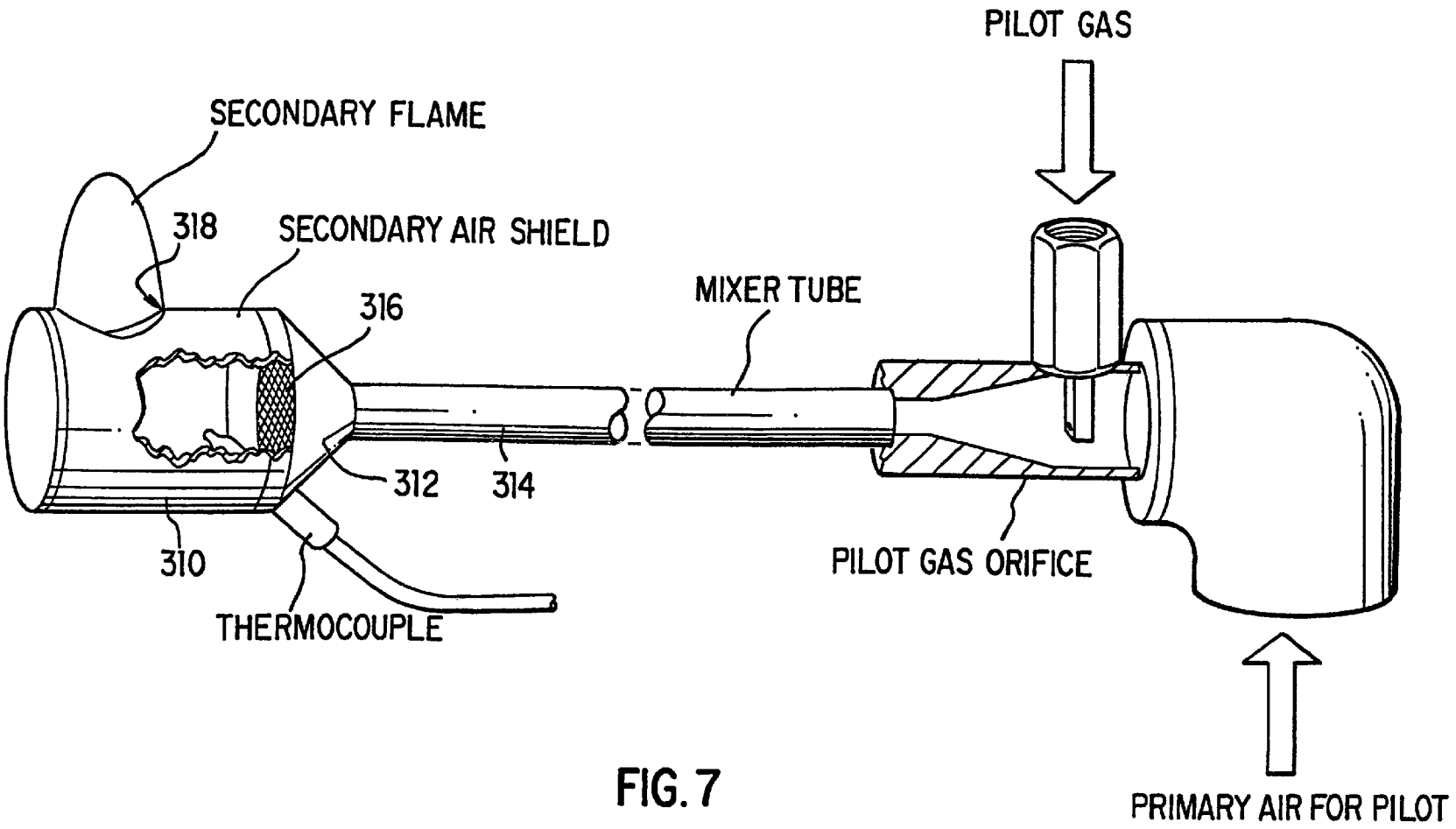
FIG. 7 is an enlarged partial sectional front view of a pilot burner having a horizontally oriented secondary air shield.

The secondary air shield can have either axial or vertical pilots, such as shown in FIGS. 1, 2, 5 and 6, or radial or horizontal pilots, such as shown in FIGS. 3 and 7, exit orientations for the unburnt gases and combustion products.

FIG. 6 is an enlarged illustration of a pilot burner configuration in which the secondary air shield has a vertical orientation, such as may be employed in the embodiments of FIGS. 1, 2, and 5. The pilot burner shown in FIG. 6 is substantially identical to that shown in FIGS. 1 and 2, and may be supplied with premixed air and fuel gas by components which are similar to or the same as those shown in FIGS. 1 and 2. A typical secondary air shield will have a cylindrical body 201, resting upon a flange 202 which surrounds a primary pilot flame holder 204, which may have the construction as discussed elsewhere herein. The upper end of the cylindrical body 201 may have an opening which, as discussed, is smaller in diameter than the interior of the cylindrical body, which can be accomplished by providing a radially inwardly projecting lip 206 which can also be concave and/or conical. Such a construction may aid in providing a location for the secondary pilot flame to stabilize. In the vertical orientation, the upper end of the secondary air shield is open. A vertical orientation facilitates mounting of the pilot unit through bottom pan of an appliance such as a water heater.

FIG. 7 illustrates a pilot burner having a horizontally oriented secondary flame holder. The supply of fuel gas and primary air may be accomplished in a manner similar to that described with respect to FIG. 3. A typical secondary air shield will have a cylindrical body 310, extending from a conical fitting 312 connected to a mixer tube 314. Secondary air shield 310 will surround a primary pilot flame holder 316, which may have the construction as discussed elsewhere in this specification. The far end of cylindrical body 310 is closed. Opening 318 is positioned within a side of cylindrical body 310, to provide a location for the secondary pilot flame. A horizontal orientation facilitates mounting of the pilot unit in existing water heater designs, with minimal alteration of the existing design construction.

In the horizontal (radial exit) orientation, unburnt gases discharge radially from the secondary air shield. Typically, a hole of diameter approximately equal to the exit diameter of a secondary air shield constructed for vertical (axial) orientation is formed within a side of the secondary air shield. The radial exit orientation permits mounting a pilot horizontally and adjacent to the main burner fuel gas transporting member, which is a manner similar to the manner in which a conventional pilot is installed in a conventional water heater. The horizontal, lateral exit configuration may be preferred in some applications as being easier to fit into existing appliance (e.g., water heater) designs.

In a still further alternative embodiment (not shown), a horizontal, axial, secondary air shield configuration can be provided, similar to that shown in FIG. 1 but simply tipped over 90°. Alternatively, an axial-type secondary air shield may be provided, in which the longitudinal axis of the air shield is tilted at some angle to the vertical, between 0° and 90°.

Additional design considerations, readily apparent to one of ordinary skill in the art, having the present disclosure before them, such as issues of dealing with water condensation in the combustion chamber during operation, may require slight modification of the secondary air shield, depending upon the particular appliance application. Such modifications may include the placement of a shield at a top of a vertically oriented secondary air shield (to deflect falling condensate) or the provision of a drainage hole in the lower portion of a horizontally oriented air shield (to prevent pooling or collection of condensate). Such measures may be taken in order to prevent the condensed material from quenching the pilot flame.

As the level of a flammable vapor present in the air ambient to the appliance increases, the air-to-fuel ratio of the pre-mixed pilot burner decreases. This decrease causes a decrease in the flame temperature and a decrease in the burning velocity of the flame. Burning velocity of a flame is the rate at which a flame progresses into a fuel mixture relative to the speed of the fuel mixture discharged through the openings in the flame holder. The decrease in burning velocity is a fundamental cause for the change in flame position and shape.

As a result of the decrease in flame temperature and the changes in flame position and shape, the output from the thermocouples in the pre-mixed pilot burner decreases. Furthermore, the output from the thermocouples also decreases as the level of flammable vapor increases. Well before the lower flammability level of a flammable vapor is reached, the thermocouple output decays to a level too low to energize the gas safety valve, typically less than two millivolts for a typical thermocouple.

For example, if the flame velocity of the primary pilot flame decreases sufficiently, for example, due to a substantial increase in the presence of flammable vapors in the ambient air, the primary pilot flame will lift off completely from primary pilot flame holder. In the absence of the primary pilot flame, the thermocouple will cool rapidly and, in turn, a corresponding voltage output will drop rapidly. The thermocouple output may be used as the driving voltage of a solenoid in the gas valve to keep the gas valve open. If the thermocouple voltage drops below a preselected absolute value, the amount of voltage required to keep the solenoid open, the solenoid will close and the gas flow will stop.

This primary pilot flame lift off phenomenon should occur in each embodiment of this invention, regardless of whether a secondary pilot flame is stabilized. In the embodiments where a secondary pilot flame is stabilized, the primary pilot flame forms inside the secondary air shield, and a secondary pilot flame will form at the exit to the secondary air shield, and upon lift off, the primary pilot flame will move to the top of the secondary air shield, and the secondary flame will expand and move upward enough to accommodate the primary flame, and to permit diffusion of air around its periphery, to maintain both flames.

The control of a gas valve solenoid may be accomplished in another manner. The cooling of the thermocouple over time is a non-linear function. The slope of the curve of temperature versus time is initially steep, then flattens. The signal of the thermocouple may be fed into a suitably programmed microprocessor or similar control device, and the voltage values monitored over time. If the rate of change of temperature over time is noted to have a large, negative value, which would correspond to rapid cooling, then shutdown of the gas flow may be demanded, quickly after lift off of the primary pilot flame, without need to wait for the thermocouple to actually cool down to a particular temperature. The steep negative slope of the temperature/time curve will indicate cooling from flame lift off before the thermocouple has time to cool down to an actual temperature which would be conclusive evidence of lift off. It is desirable to detect and respond to primary pilot flame lift off as quickly as possible.

A preferred configuration of the pre-mixed pilot burner and thermocouple system is to arrange the primary flame aeration, flame holder, secondary air shield, such that at a flammable vapor concentration of 30% to 50% by volume, of the butane LFL (0.54% to 0.9% by volume butane in air), there is a sharp decrease in the burning velocity of the flame. The change of the burning velocity causes the flame to completely lift-off from the pre-mixed pilot burner flame holder and extinguish itself With the pilot flame extinguished, the output from the thermocouple decreases quickly. This configuration significantly improves the speed of response for the pre-mixed pilot burner and thermocouple system.

Figure 15:
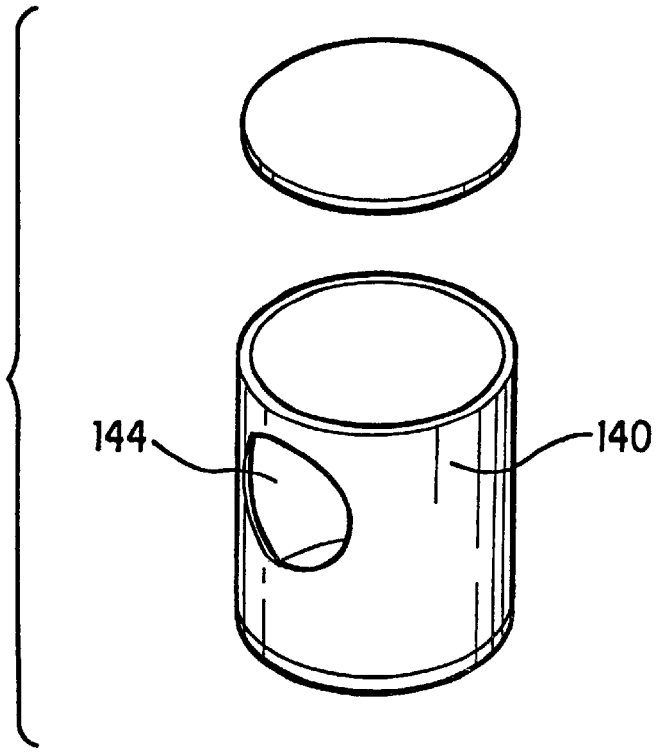
FIG. 15 is a perspective exploded view of the secondary air shield, as shown in FIG. 14.
Figure 16:
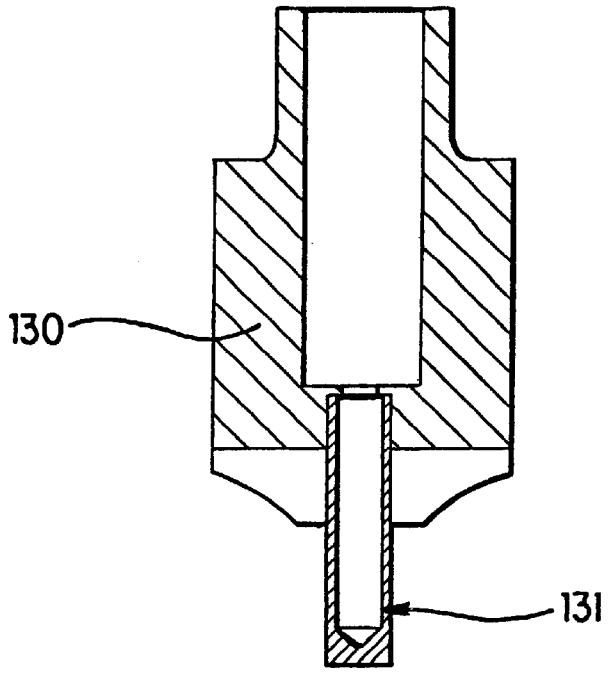
FIG. 16 is a cross-sectional view of a fuel gas nozzle, according to one preferred embodiment of this invention.
Figure 17:
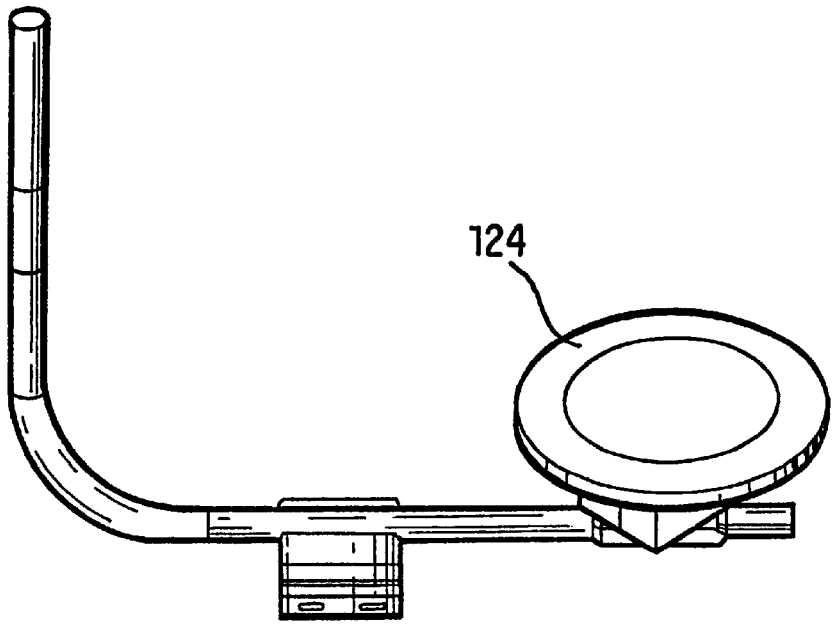
FIG. 17 is a perspective view of a fuel gas transporting member connected to a main burner assembly, according to one preferred embodiment of this invention.
Figure 18:
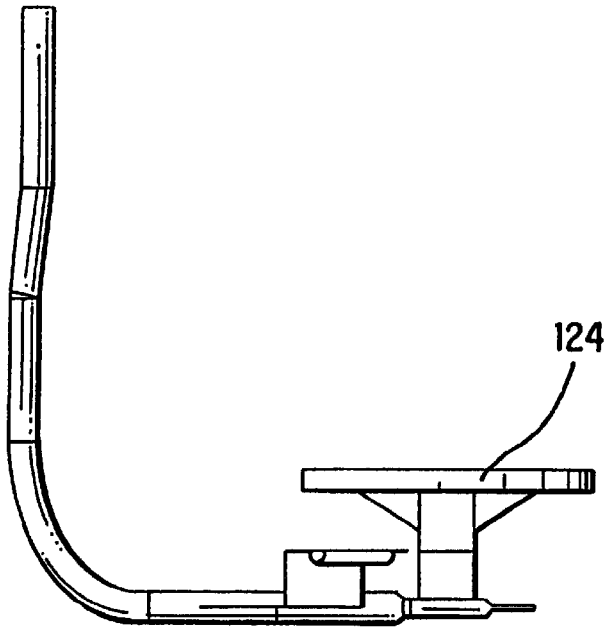
FIG. 18 is a front view of the fuel gas transporting member and main burner assembly, as shown in FIG. 17.
Figure 19:
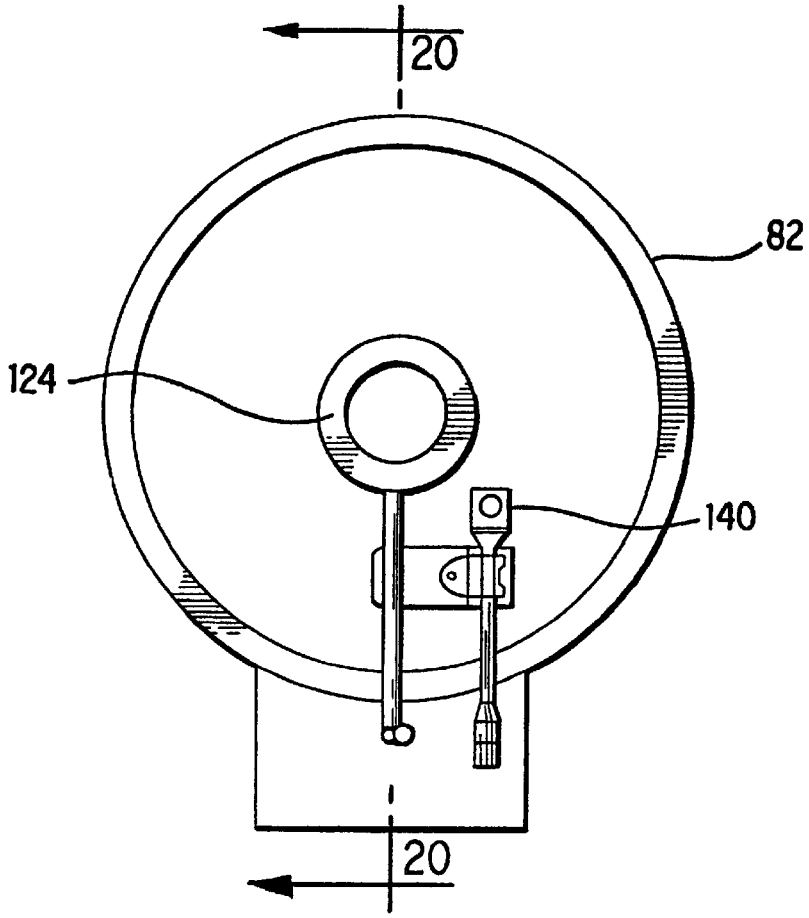
FIG. 19 is a schematic top view of a water heater showing a layout of a pilot burner assembly and a main burner assembly, according to one preferred embodiment of this invention.

FIGS. 8–16 show different elements of a pilot burner assembly, according to another preferred embodiment of this invention. FIGS. 8–10 show different views of the pilot assembly. Fuel gas and air are mixed at mixer tube 128. According to the embodiment shown in FIGS. 8–10, fuel gas enters mixer tube 128 through nozzle 130. As shown in FIG. 16, according to one preferred embodiment of this invention, nozzle 130 comprises a body having a cavity which communicates with orifice 131 and a passageway of mixer tube 128. Orifice 131 is preferably positioned to inject fuel gas in a generally downstream direction, with respect to normal flow through the pilot tube assembly, such as in a direction from right to left as shown in FIGS. 8–10. However, the fuel gas can be injected in any suitable direction that promotes adequate mixing, for example depending upon the resultant fuel/air ratio desired, within mixer tube 128.

FIG. 10 shows gas tube 126 connected to and in communication with the cavity formed by nozzle 130. It is apparent that any other suitable fuel supply known to those skilled in the art of combustion, can be used in lieu of gas tube 126, to supply fuel gas to the cavity formed by nozzle 130.

The preferred embodiment of this invention shown in FIGS. 8–10 differs from previously described preferred embodiments of this invention, because opening 132 can be exposed to any desired environment by connecting tubing, piping or any other suitable fluid carrier about opening 132. Thus, opening 132 can communicate with an area remote from, at, near or in the immediate vicinity of a water heater, such as at floor level or any other level within the room in which the water heater is located. The tubing, for example, can have one end attached to the fitting that forms opening 132 and an opposite end positioned in the desired environment, which can be in the same room, a different room or any other suitable environment.

In one preferred embodiment according to this invention, the fitting forming opening 132 is routed through or mounted within a lower portion of a side wall of air dam 86, or through a bottom wall of air dam 86.

The pilot burner assembly shown in FIGS. 8–10 can be positioned entirely within air dam 86 or can be positioned outside of the water heater, as described with respect to previous preferred embodiments of this invention. Different than prior preferred embodiments of this invention where mixer tube 128 is spaced a distance from a discharge of nozzle 130, the preferred embodiment of the apparatus according to this invention as shown in FIGS. 8–10 does not require mixer tube 128 to be positioned within the environment from which air is drawn to supply combustion of the pilot flame. Thus, one advantage of the preferred embodiment of this invention as shown in FIGS. 8–10 is that opening 132 can be forced to communicate only with any desired environment by using tubing, piping or another fluid carrier, as previously discussed.

Figure 12:
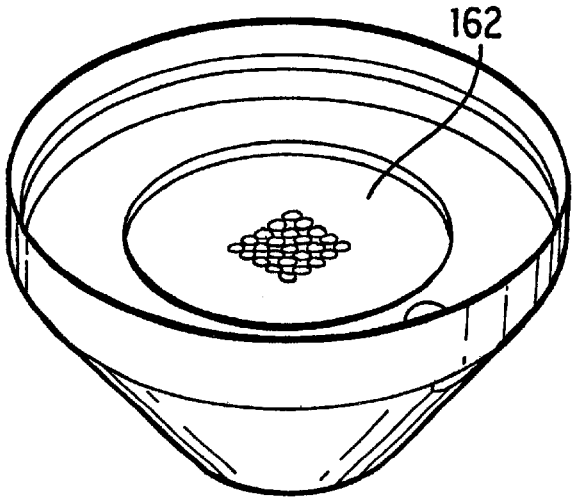
FIG. 12 is a perspective view of a primary flame holder mounted within a base, according to one preferred embodiment of this invention.
Figure 13:
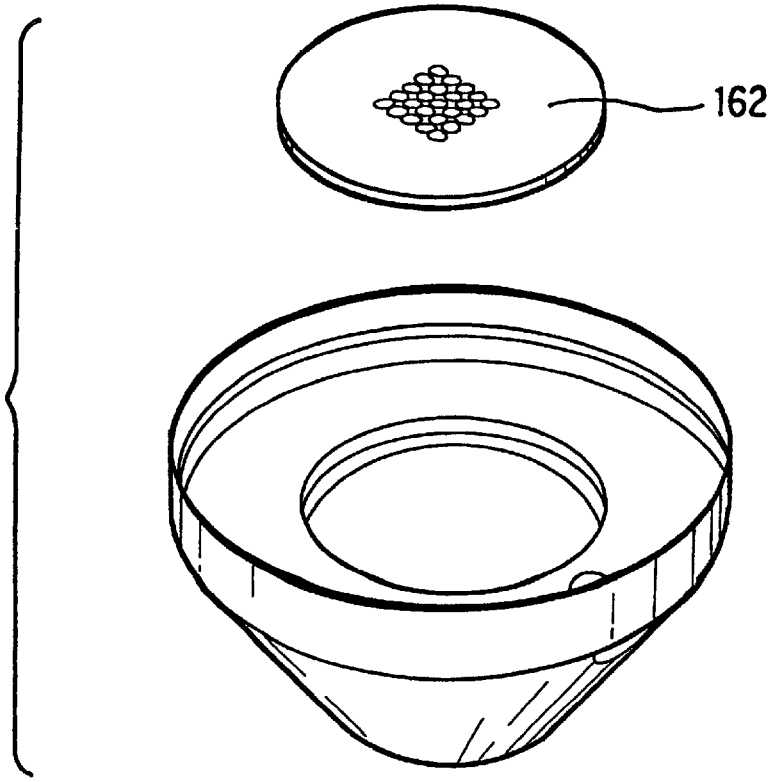
FIG. 13 is a perspective exploded view of the primary flame holder mounted within a base, as shown in FIG. 12.
Figure 14:
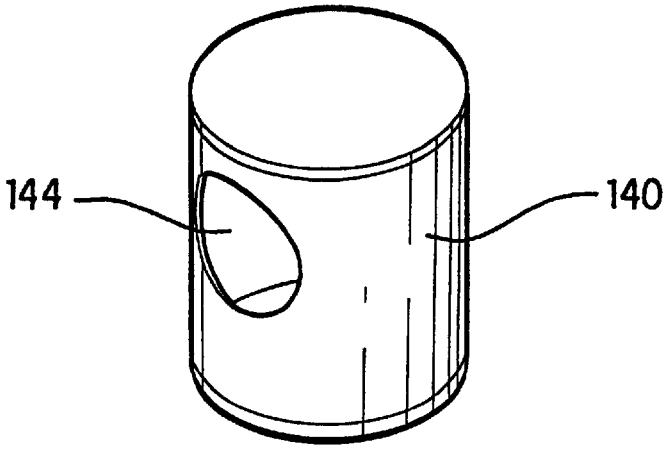
FIG. 14 is a perspective view of a secondary air shield, according to one preferred embodiment of this invention.

FIGS. 12 and 13 show components of pilot burner apparatus 136, including primary flame holder 162 on which the primary pilot flame is established. FIGS. 14 and 15 show secondary air shield 140 which defines aperture 144, according to one preferred embodiment of this invention.

FIGS. 17–21 show a main burner assembly, according to another preferred embodiment of this invention.

Figure 20:
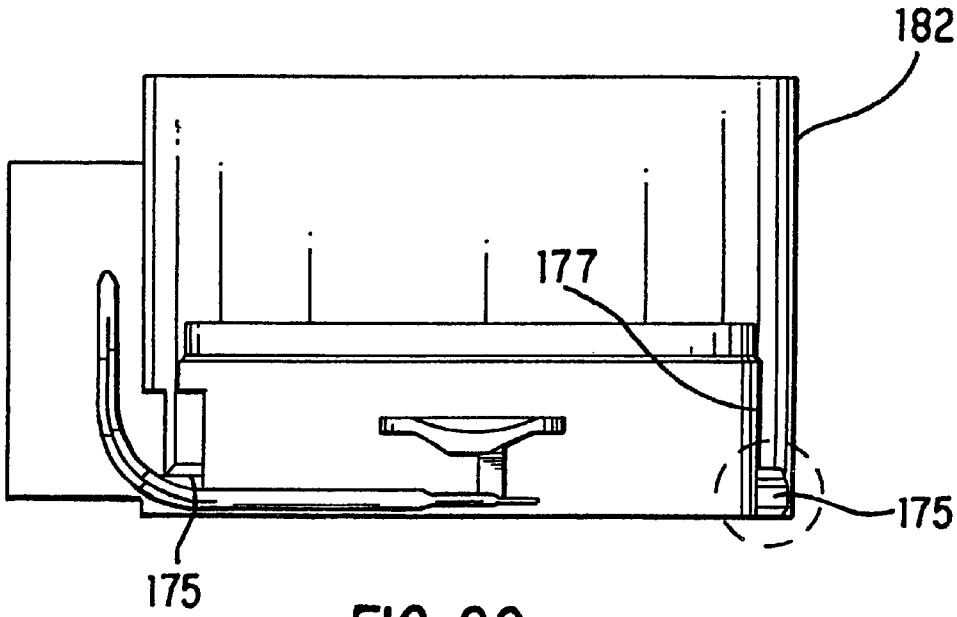
FIG. 20 is schematic side view of the water heater, pilot burner assembly and main burner assembly, as shown in FIG. 19.
Figure 23:
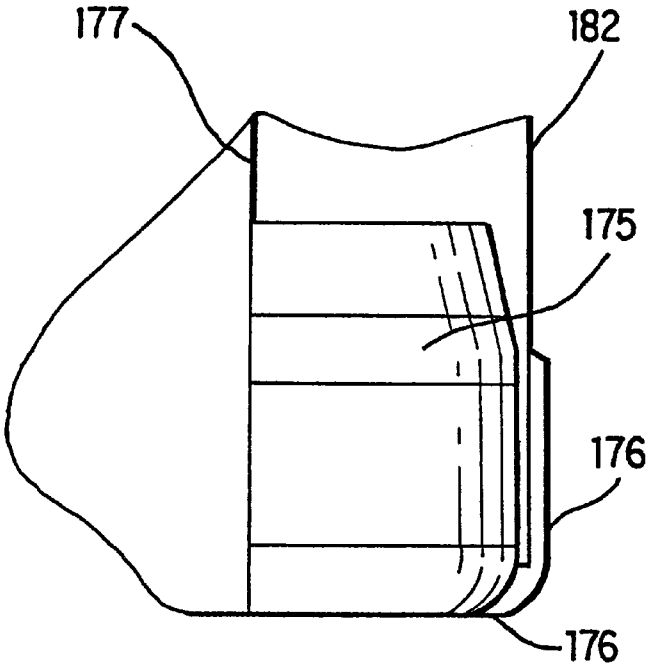
FIG. 23 is an enlarged schematic view showing a position of the sealing ring shown in FIG. 22, in the region of the water heater as shown in dashed lines in FIG. 20, according to one preferred embodiment of this invention.
Figure 22:
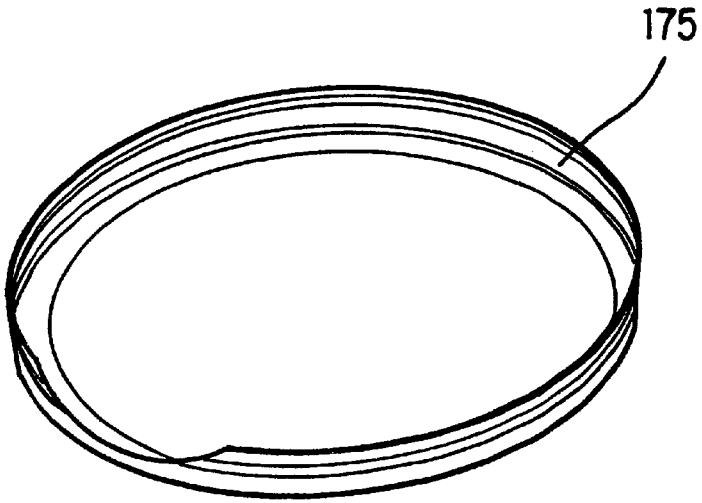
FIG. 22 is a perspective front view of a sealing and stiffening ring, according to one preferred embodiment of this invention.

FIG. 22 shows sealing ring 175, in a perspective view, according to one preferred embodiment of this invention. FIG. 20 shows the general position of sealing ring 175 when mounted in a water heater. FIG. 23 shows an enlarged partial view of sealing ring 175 positioned between shell 182 and skirt 177. Sealing ring 175 is preferably positioned close enough to the side wall of bottom pan 176 so that shell 182 can be inserted between sealing ring 175 and the side wall of bottom pan 176 to sufficiently close any gap and thus form a seal. In one preferred embodiment according to this invention., sealing ring 175 can be a stamped or roll-formed ring with outer peripheral sides directed radially inward, as shown in FIG. 23. When installed, sealing ring 175 forms a seal which can be but is not necessarily a hermetic seal. Sealing ring 175 preferably forms a metal-to-metal seal that is sufficient to prevent undesired flammable vapors from entering combustion chamber 88. Sealing ring 175 can be spot welded or continuously welded or otherwise mechanically fastened to bottom pan 176 and/or shell 182. Sealing ring 175 also acts as a stiffener for strengthening the bottom portion of a hot water heater. The stiffening aspects of sealing ring 175 can help prevent bending, crushing or other deformations, such as when a hot water heater is transported by tilting the hot water heater and rolling the hot water heater on a bottom peripheral edge.

Figure 21:
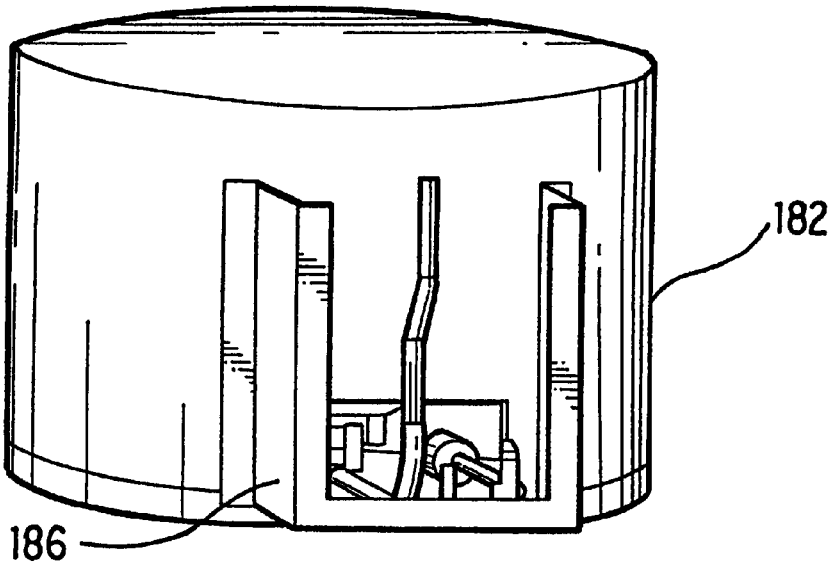
FIG. 21 is a perspective front view of the water heater, pilot burner assembly and main burner assembly, as shown in FIGS. 19 and 20.

In one preferred embodiment of this invention, air dam 186, as shown in FIG. 21, is attached to an external surface of shell 182. The connection between air dam 186 and shell 182 preferably forms a seal so that undesired flammable vapors do not enter the interior space defined by air dam 186, through such sealed area.

It should be noted that the particular constructions of the primary pilot air supply, pilot fuel gas supply, pilot gas orifice, etc. (all being upstream of the mixer tube) in each of the embodiments of FIGS. 6 and 7 are functionally interchangeable, and vary only to accommodate the structural requirements of particular installations, and may be so varied readily by one of ordinary skill in the art having the present disclosure before them.

The foregoing description and drawings merely explain and illustrate this invention and the invention is not limited thereto except insofar as the appended claims are so limited, as those skilled in the art having the disclosure before them will be able to make modifications and variations therein without departing from the scope of this invention.

We claim:

1. In a heating apparatus comprising a shell, a main combustion chamber disposed within said shell, a main burner disposed within said shell and a pilot burner having an operating mode and a shutdown mode arranged to enable ignition of said main burner when in said operating mode, a method for controlling said pilot burner comprising the steps of:

drawing a first portion of air from a first environment comprising air into said main combustion chamber through an open top of an air dam attached to said shell, said open top of said air dam being in fluid communication with said main combustion chamber;

drawing a second portion of air from a second environment comprising air through a tube connected to said pilot burner, said tube having one end in fluid communication with said main combustion chamber and an opposite end in fluid communication with said second environment; and determining a relative concentration of an undesired flammable vapor in said first environment and said second environment, whereby one of continuing operation and shutdown of said pilot burner is carried out.

2. A method in accordance with claim 1, wherein said first environment has a composition different from said second environment, whereby said pilot burner is in said shutdown mode.

3. A method in accordance with claim 2, wherein said at least one undesired flammable vapor is disposed only in said second environment.

4. A method in accordance with claim 2, wherein said first environment and said second environment comprise different concentrations of said at least one undesired flammable vapor.

5. A method in accordance with claim 1, wherein said first environment and said second environment have substantially corresponding compositions, whereby said pilot burner is in said operating mode.

6. A method in accordance with claim 1, wherein said second environment is at an elevation lower than said open top of said air dam.

7. A method in accordance with claim 1, wherein said pilot burner comprises a primary flame holder connected to said one end of said tube and said first portion of air is maintained separate from said second portion of air by an air shield disposed around said primary flame holder.

8. A method in accordance with claim 1, wherein said main burner and said tube are in fluid communication with a fuel gas supply and said shutdown of said pilot burner is achieved by closing a fuel gas supply valve in fluid communication with said main burner, said tube and said fuel gas supply disposed downstream of said fuel gas supply.

9. A method for operating and shutting down a pilot burner apparatus of an appliance having a shell and a main combustion chamber within the shell, the method comprising:

drawing first air from a first atmosphere into the main combustion chamber through an open top of an air dam attached to the shell wherein the open top of the air dam in communication with the main combustion chamber and with the first atmosphere of a first environment; and drawing second air from a second atmosphere through a tube connected to a pilot burner wherein the tube has one end in communication with the main combustion chamber and an opposite end in communication with the second atmosphere of a second environment which in a shutdown condition is significantly different than the first environment.

* * * * *